US010815597B2

(12) United States Patent
Budicky et al.

(10) Patent No.: US 10,815,597 B2
(45) Date of Patent: Oct. 27, 2020

(54) LAUNDRY TREATING APPLIANCE HAVING A LIQUID DISTRIBUTION ASSEMBLY

(71) Applicant: WHIRLPOOL CORPORATION, Benton Harbor, MI (US)

(72) Inventors: Tibor Budicky, Poprad (SK); Bystrik Cervenka, Poprad (SK); Crescenzo Iannicelli, Fabriano (IT); Mauro Mancini, Fabriano (IT); Jan Martinko, Poprad (SK); Vladimir Olejar, Poprad (SK); Vaclav Petracek, Poprad (SK)

(73) Assignee: Whirlpool Corporation, Benton Harbor, MI (US)

( * ) Notice: Subject to any disclaimer, the term of this patent is extended or adjusted under 35 U.S.C. 154(b) by 219 days.

(21) Appl. No.: 15/993,780

(22) Filed: May 31, 2018

(65) Prior Publication Data

US 2019/0368101 A1 Dec. 5, 2019

(51) Int. Cl.

| | |
|---|---|
| ***D06F 37/06*** | (2006.01) |
| ***D06F 39/02*** | (2006.01) |
| ***D06F 39/08*** | (2006.01) |

(52) U.S. Cl.

CPC ..... *D06F 37/065* (2013.01); *D06F 39/024* (2013.01); *D06F 39/088* (2013.01); *D06F 2212/02* (2013.01)

(58) Field of Classification Search

CPC ..... D06F 37/065

See application file for complete search history.

(56) References Cited

U.S. PATENT DOCUMENTS

| | | | |
|---|---|---|---|
| 6,393,873 | B1 | 5/2002 | Myerscough |
| 6,981,395 | B2 | 1/2006 | Ryu et al. |
| 2006/0081018 | A1 | 4/2006 | Kim |
| 2018/0135221 | A1 | 5/2018 | Nishino et al. |

FOREIGN PATENT DOCUMENTS

| | | | |
|---|---|---|---|
| CN | 107476002 | A | 12/2017 |
| DE | 4002809 | A1 | 1/1991 |
| DE | 19962257 | A1 | 6/2001 |
| EP | 1693500 | A2 | 8/2006 |
| EP | 2463432 | A1 | 6/2012 |
| IN | 09911DN2014 | | 8/2015 |
| WO | 2009083352 | A1 | 7/2009 |
| WO | 2011144559 | A1 | 11/2011 |

OTHER PUBLICATIONS

European Patent Office, European Search Report re Application No. 19173960.6-1018, dated Sep. 3, 2019, 7 pages, Munich, Germany.

*Primary Examiner* — Joseph L. Perrin
*Assistant Examiner* — Irina Graf
(74) *Attorney, Agent, or Firm* — McGarry Bair PC

(57) ABSTRACT

A laundry treating appliance is disclosed. The laundry treating appliance includes a tub having a tub side wall and a tub end wall defining a liquid chamber with a tub end opening. A tub manifold portion is positioned at the tub end wall. A rotatable drum is located within the liquid chamber, rotatable about a rotational axis, and has a drum side wall and a drum end wall at least partially defining a treating chamber with a drum end opening. A drum manifold portion is positioned at the drum end wall and confronts the tub manifold portion. At least one lifter is secured to the drum, and a liquid conduit fluidly couples the drum manifold portion to the at least one lifter.

20 Claims, 6 Drawing Sheets

LAUNDRY TREATING APPLIANCE HAVING A LIQUID DISTRIBUTION ASSEMBLY

BACKGROUND

Laundry treating appliances, such as washing machines, combination washer/dryers, refreshers, and non-aqueous systems, can have a configuration based on a rotating drum that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, can be supplied to the treating chamber in accordance with the cycle of operation and via a liquid distribution assembly.

BRIEF SUMMARY

In one aspect, illustrative embodiments in accordance with the present disclosure relate to a laundry treating appliance. The laundry treating appliance includes a tub having a tub side wall and a tub end wall defining a liquid chamber with a tub end opening, a tub manifold portion positioned at the tub end wall, a rotatable drum located within the liquid chamber, rotatable about a rotational axis, and having a drum side wall and a drum end wall at least partially defining a treating chamber with a drum end opening, a drum manifold portion positioned at the drum end wall and confronting the tub manifold portion, at least one lifter secured to the drum, a liquid conduit fluidly coupling the drum manifold portion to the at least one lifter, and a sealing interface between the tub manifold portion and the drum manifold portion.

DETAILED DESCRIPTION

Aspects of the disclosure relate to a liquid distribution assembly for a laundry treating appliance. In traditional washing machines, liquid can be delivered to the treating chamber via a liquid inlet or a spray nozzle provided, for example, at or near the opening of the treating chamber, which is typically a rotatable basket/drum located within a tub. In the case of a horizontal axis laundry treating appliance, a bellows extends and seals the treating chamber between the tub and the door of the laundry treating appliance, and the spray nozzle can extend through the bellows. The location of the spray nozzle in the bellows can result in uneven distribution of liquid and/or treating chemistries to the laundry items within the treating chamber because the liquid and treating chemistry may not sufficiently wet laundry items that are located at the rear of the tub or at the bottom of the tub. By providing liquid to the treating chamber via lifters provided within the drum, liquid and treating chemistries can be more evenly distributed within the treating chamber for improved washing performance. Providing liquid via the lifters can result in liquid passing through a tub rear portion, through a drum rear portion, then into the lifters. Sealing the interface between the fixed tub rear portion and the rotating drum rear portion with minimal leaking requires sealing structures to be provided. The present disclosure sets forth a washing machine having a liquid distribution assembly in which liquid and/or treating chemistries flow through a tub rear portion, through a drum rear portion, and into at least one lifter, through which it enters the treating chamber. Such a liquid distribution assembly results in improved washing performance for laundry items located at any position within the treating chamber.

Figure 1:
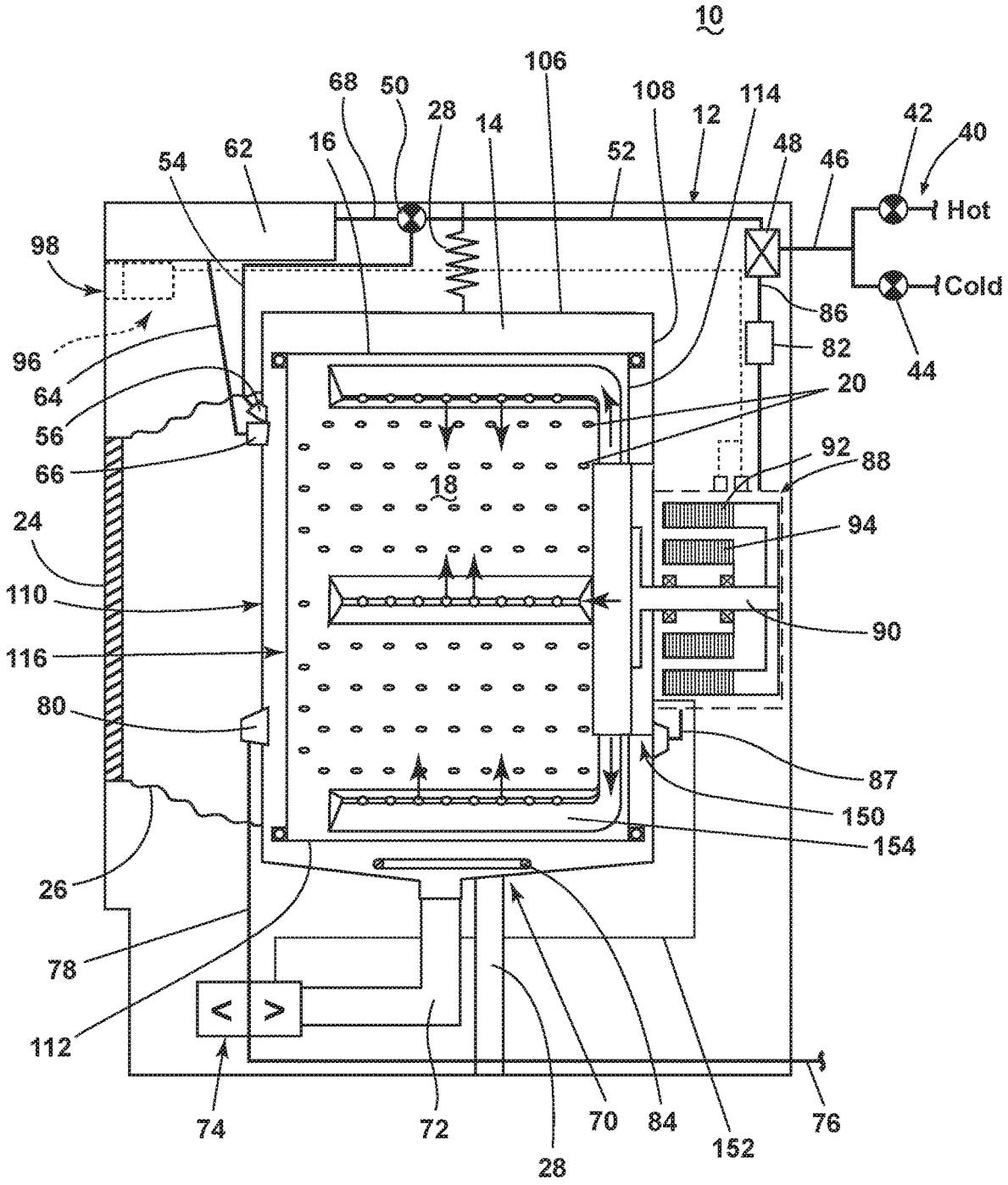
FIG. 1 illustrates a schematic cross-sectional view of a laundry treating appliance in the form of a washing machine having a liquid distribution assembly according to an embodiment of the present disclosure.

FIG. 1 is a schematic cross-sectional view of a laundry treating appliance according to an embodiment of the present disclosure. The laundry treating appliance can be any appliance which performs an automatic cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. While the laundry treating appliance is illustrated herein as a horizontal axis, front-load laundry treating appliance, the embodiments of the present disclosure can have applicability in laundry treating appliances with other configurations.

Washing machines are typically categorized as either a vertical axis washing machine or a horizontal axis washing machine. As used herein, the term "horizontal axis" washing machine refers to a washing machine having a rotatable drum that rotates about a generally horizontal axis relative to a surface that supports the washing machine. The drum can rotate about the axis inclined relative to the horizontal axis, with fifteen degrees of inclination being one example of the inclination. Similar to the horizontal axis washing machine, the term "vertical axis" washing machine refers to a washing machine having a rotatable drum that rotates about a generally vertical axis relative to a surface that supports the washing machine. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum.

The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis.

As used herein, the "horizontal axis" washing machine refers to a washing machine having a rotatable drum, perforated or imperforate, that holds laundry items and washes the laundry items. In some horizontal axis washing machines, the drum rotates about a horizontal axis generally parallel to a surface that supports the washing machine. However, the rotational axis need not be horizontal. The drum can rotate about an axis inclined or declined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a washing machine can be top-loading or front-loading. In a top-loading washing machine, laundry items are placed into the drum through an access opening in the top of a cabinet, while in a front-loading washing machine laundry items are placed into the drum through an access opening in the front of a cabinet. If a washing machine is a top-loading horizontal axis washing machine or a front-loading vertical axis washing machine, an additional access opening is located on the drum.

The exemplary laundry treating appliance of FIG. 1 is illustrated as a horizontal axis washing machine 10, which can include a structural support system comprising a cabinet 12 which defines a housing within which a laundry holding system resides. The cabinet 12 can be a housing having a chassis and/or a frame, to which decorative panels can or cannot be mounted, defining an interior enclosing components typically found in a conventional washing machine, such as motors, pumps, fluid lines, controls, sensors, transducers, and the like. Such components will not be described further herein except as necessary for a complete understanding of the present disclosure.

The laundry holding system comprises a tub 14 dynamically suspended within the structural support system of the cabinet 12 by a suitable suspension system 28 and a drum 16 provided within the tub 14, the drum 16 defining at least a portion of a laundry treating chamber 18. The tub 14 comprises a tub side wall 106 and a tub end wall 108 and defines a tub end opening 110 and a liquid chamber. The drum 16 is provided within the liquid chamber and comprises a drum side wall 112 and a drum end wall 114 and defines a drum end opening 116. The drum 16 is configured to receive a laundry load comprising articles for treatment, including, but not limited to, a hat, a scarf, a glove, a sweater, a blouse, a shirt, a pair of shorts, a dress, a sock, and a pair of pants, a shoe, an undergarment, and a jacket. The drum 16 can include a plurality of perforations 20 such that liquid can flow between the tub 14 and the drum 16 through the perforations 20. It is also within the scope of the present disclosure for the laundry holding system to comprise only one receptacle with the receptacle defining the laundry treating chamber for receiving the load to be treated.

The laundry holding system can further include a door 24 which can be movably mounted to the cabinet 12 to selectively close both the tub 14 and the drum 16. A bellows 26 can couple an open face of the tub 14 with the cabinet 12, with the door 24 sealing against the bellows 26 when the door 24 closes the tub 14.

The washing machine 10 can further include a liquid supply system for supplying water to the washing machine 10 for use in treating laundry during a cycle of operation. The liquid supply system can include a source of water, such as a household water supply 40, which can include separate valves 42 and 44 for controlling the flow of hot and cold water, respectively. Water can be supplied through an inlet conduit 46 directly to the tub 14 by controlling first and second diverter mechanisms 48 and 50, respectively. The diverter mechanisms 48, 50 can be a diverter valve having two outlets such that the diverter mechanisms 48, 50 can selectively direct a flow of liquid to one or both of two flow paths. Water from the household water supply 40 can flow through the inlet conduit 46 to the first diverter mechanism 48 which can direct the flow of liquid to a supply conduit 52. The second diverter mechanism 50 on the supply conduit 52 can direct the flow of liquid to a tub outlet conduit 54 which can be provided with a spray nozzle 56 configured to spray the flow of liquid into the tub 14. In this manner, water from the household water supply 40 can be supplied directly to the tub 14. While the valves 42, 44 and the conduit 46 are illustrated exteriorly of the cabinet 12, it will be understood that these components can be internal to the cabinet 12.

The washing machine 10 can also be provided with a dispensing system for dispensing treating chemistry to the treating chamber 18 for use in treating the laundry according to a cycle of operation. The dispensing system can include a treating chemistry dispenser 62 which can be a single dose dispenser, a bulk dispenser, or an integrated single dose and bulk dispenser and is fluidly coupled to the treating chamber 18. The treating chemistry dispenser 62 can be configured to dispense a treating chemistry directly to the tub 14 or mixed with water from the liquid supply system through a dispensing outlet conduit 64. The dispensing outlet conduit 64 can include a dispensing nozzle 66 configured to dispense the treating chemistry into the tub 14 in a desired pattern and under a desired amount of pressure. For example, the dispensing nozzle 66 can be configured to dispense a flow or stream of treating chemistry into the tub 14 by gravity, i.e. a non-pressurized stream. Water can be supplied to the treating chemistry dispenser 62 from the supply conduit 52 by directing the diverter mechanism 50 to direct the flow of water to a dispensing supply conduit 68.

The treating chemistry dispenser 62 can include multiple chambers or reservoirs for receiving doses of different treating chemistries. The treating chemistry dispenser 62 can be implemented as a dispensing drawer that is slidably received within the cabinet 12, or within a separate dispenser housing which can be provided in the cabinet 12. The treating chemistry dispenser 62 can be moveable between a fill position, where the treating chemistry dispenser 62 is exterior to the cabinet 12 and can be filled with treating chemistry, and a dispense position, where the treating chemistry dispenser 62 are interior of the cabinet 12.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 can also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and can flow by gravity to a sump 70 formed in part by a lower portion of the tub 14. The sump 70 can also be formed by a sump conduit 72 that can fluidly couple the lower portion of the tub 14 to a pump 74. The pump 74 can direct liquid to a drain conduit 76, which can drain the liquid from the washing machine 10, or to a recirculation conduit 78, which can terminate at a recirculation inlet 80. The recirculation inlet 80 can direct the liquid from the recirculation conduit 78 into the drum 16. The recirculation inlet 80 can introduce the liquid into the drum 16 in any suitable manner, such as by spraying, dripping, or providing a steady flow of liquid. In addition to, or in place of, the recirculation inlet 80, the pump 74 can direct liquid to a liquid distribution assembly 150 via a distribution conduit 152. The distribution conduit 152 can be fluidly coupled to the tub 14 and the drum 16, as well as to at least one lifter 154, such that liquid can be introduced into the treating chamber 18 via the at least one lifter 154. In this manner, liquid provided to the tub 14, with or without treating chemistry can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 82 and/or a sump heater 84. Liquid from the household water supply 40 can be provided to the steam generator 82 through the inlet conduit 46 by controlling the first diverter mechanism 48 to direct the flow of liquid to a steam supply conduit 86. Steam generated by the steam generator 82 can be supplied to the tub 14 through a steam outlet conduit 87. The steam generator 82 can be any suitable type of steam generator such as a flow through steam generator or a tank-type steam generator. Alternatively, the sump heater 84 can be used to generate steam in place of or in addition to the steam generator 82. In addition or alternatively to generating steam, the steam generator 82 and/or sump heater 84 can be used to heat the laundry and/or liquid within the tub 14 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The washing machine 10 also includes a drive system for rotating the drum 16 within the tub 14. The drive system can include a motor 88, which can be directly coupled with the drum 16 through a drive shaft 90 to rotate the drum 16 about a rotational axis during a cycle of operation. The motor 88 can be a brushless permanent magnet (BPM) motor having a stator 92 and a rotor 94. Alternately, the motor 88 can be coupled to the drum 16 through a belt and a drive shaft to rotate the drum 16, as is known in the art. Other motors, such as an induction motor or a permanent split capacitor (PSC) motor, can also be used. The motor 88 can rotate the drum 16 at various speeds in either rotational direction.

The washing machine 10 also includes a control system for controlling the operation of the washing machine 10 to implement one or more cycles of operation. The control system can include a controller 96 located within the cabinet 12 and a user interface 98 that is operably coupled with the controller 96. The user interface 98 can include one or more knobs, dials, switches, displays, touch screens and the like for communicating with the user, such as to receive input and provide output. The user can enter different types of information including, without limitation, cycle selection and cycle parameters, such as cycle options.

The controller 96 can include the machine controller and any additional controllers provided for controlling any of the components of the washing machine 10. For example, the controller 96 can include the machine controller and a motor controller. Many known types of controllers can be used for the controller 96. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
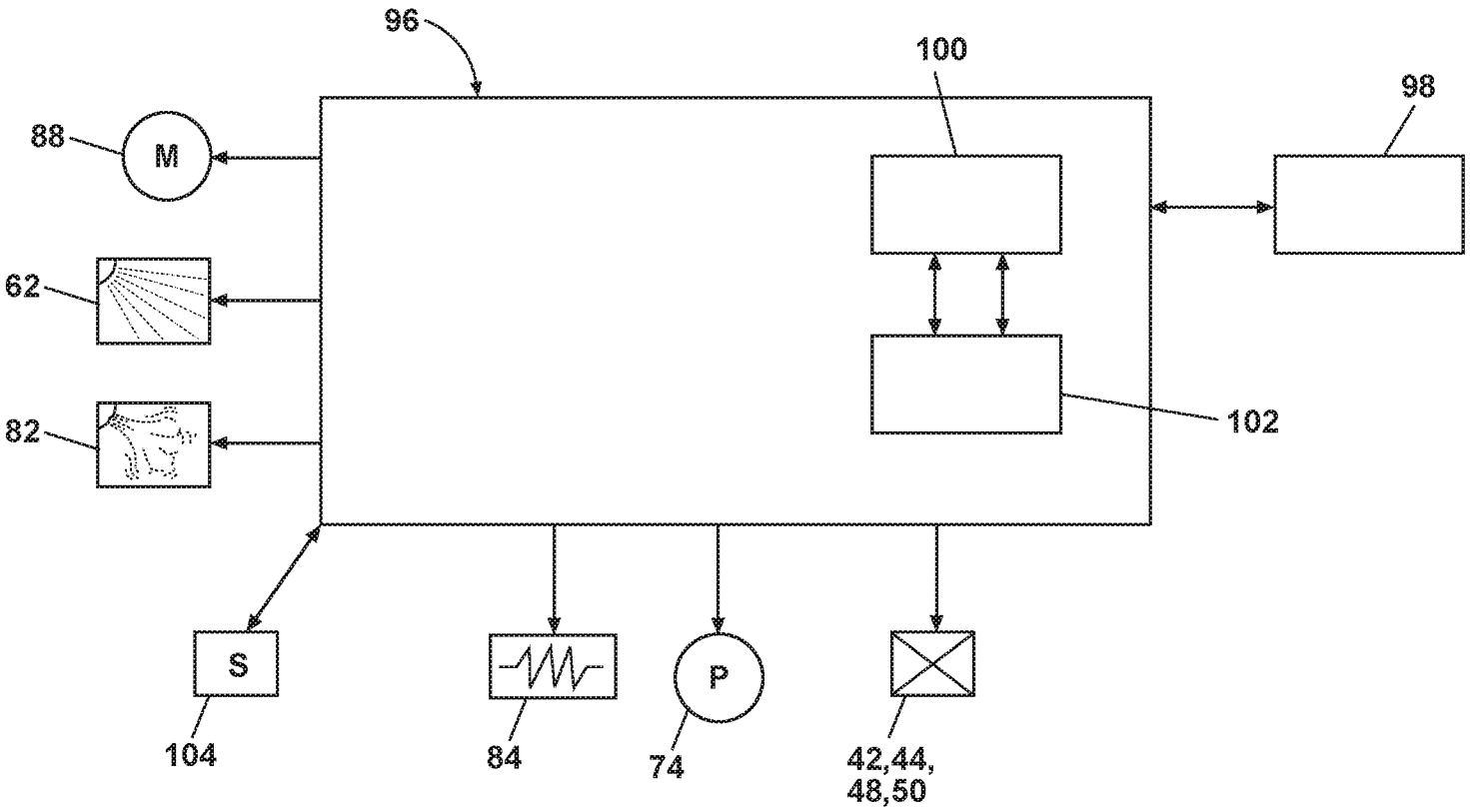
FIG. 2 illustrates a schematic of a control system of the laundry treating appliance of FIG. 1 according to an embodiment of the present disclosure.

As illustrated in FIG. 2, the controller 96 can be provided with a memory 100 and a central processing unit (CPU) 102. The memory 100 can be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 can also be used to store information, such as a database or table, and to store data received from one or more components of the washing machine 10 that can be communicably coupled with the controller 96. The database or table can be used to store the various operating parameters for the one or more cycles of operation, including factory default values for the operating parameters and any adjustments to them by the control system or by user input.

The controller 96 can be operably coupled with one or more components of the washing machine 10 for communicating with and controlling the operation of the component to complete a cycle of operation. For example, the controller 96 can be operably coupled with the motor 88, the pump 74, the treating chemistry dispenser 62, the steam generator 82, and the sump heater 84 to control the operation of these and other components to implement one or more of the cycles of operation.

The controller 96 can also be coupled with one or more sensors 104 provided in one or more of the systems of the washing machine 10 to receive input from the sensors, which are known in the art and not shown for simplicity. Non-limiting examples of sensors 104 that can be communicably coupled with the controller 96 include: a treating chamber temperature sensor, a moisture sensor, a weight sensor, a chemical sensor, a position sensor and a motor torque sensor, which can be used to determine a variety of system and laundry characteristics, such as laundry load inertia or mass.

Figure 3:
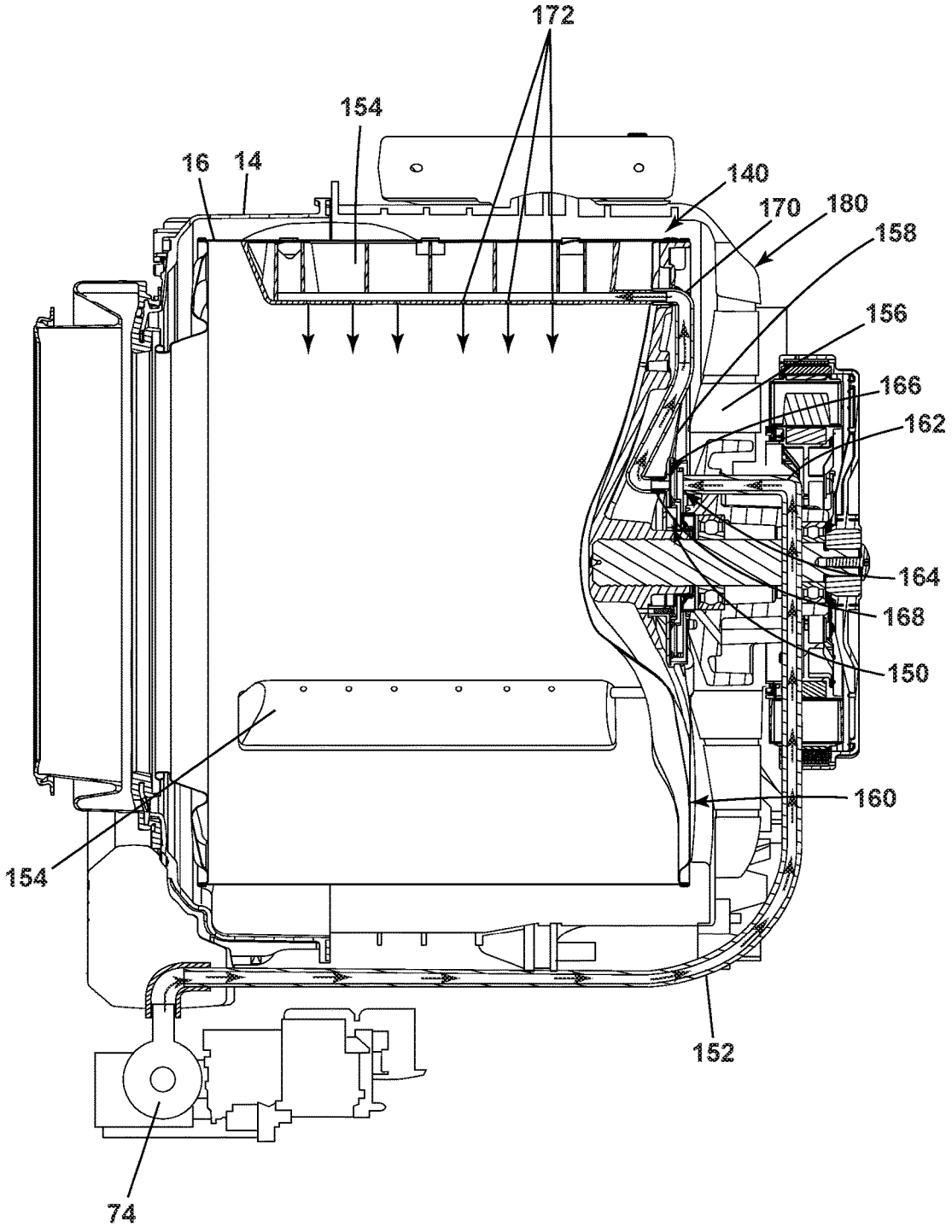
FIG. 3 illustrates a cross-sectional view of the liquid distribution assembly of FIG. 1 according to an embodiment of the present disclosure.

Referring now to FIG. 3, a cross-sectional view of a liquid distribution system of the washing machine 10, including the liquid distribution assembly 150, is shown. The liquid distribution system comprises a lifter assembly 140, including at least one lifter 154, and the liquid distribution assembly 150. The liquid distribution assembly 150 comprises a tub manifold portion 156 and a drum manifold portion 158. In an exemplary embodiment, the tub manifold portion 156 is stationary and does not rotate, while the drum manifold portion 158 is rotatable relative to the tub manifold portion 156. The tub manifold portion 156 and the drum manifold portion 158 can be thought of as confronting each other and collectively forming a liquid distribution manifold for transferring liquid from the pump 74 into the stationary tub manifold portion 156, then from the tub manifold portion 156 to the rotatable drum manifold portion 158, then on to the treating chamber 18. Because liquid is being transferred from a fixed part to a rotating part, a sealing interface 200, 300 (FIGS. 5, 6, respectively) can be provided to minimize or prevent the leaking of liquid from between the tub manifold portion 156 and the drum manifold portion 158.

The tub manifold portion 156 can be provided within a tub rear portion 180, within the tub end wall 108. The tub manifold portion 156 can be a separate piece from the tub rear portion 180, or can be integrated with the tub rear portion 180. The drum manifold portion 158 can be provided within a drum rear portion 160, within the drum end wall 114, and can be integrated with the drum rear portion 160 or can be a separate piece from the drum rear portion 160. The term integral as used herein can refer to, for example, a monolithic structure or a single-piece structure. The tub manifold portion 156 and the drum manifold portion 158 have interiors defining fluid reservoirs that are selectively fluidly coupled to each other. Further, the interiors of the tub manifold portion 156 and the drum manifold portion 158 can be thought of as being relatively fluidly sealed by the sealing interface 200, 300 to collectively define a common fluid reservoir.

The distribution conduit 152 can fluidly couple the pump 74 to a tub manifold inlet 162 formed within the tub manifold portion 156. The tub manifold inlet 162 is fluidly coupled to a tub manifold outlet 164, which is in turn fluidly coupled to a drum manifold inlet 166. The drum manifold portion 158 is fluidly coupled to the lifter assembly 140, and specifically to an interior of the lifter 154 that defines a fluid reservoir. The fluid reservoir defined by the lifter 154 can be fluidly coupled to the common fluid reservoir defined by the tub manifold portion 156, the sealing interface 200, 300, and the drum manifold portion 158. The lifter assembly 140 can be disposed on an inner surface of the drum 16 and can comprise at least one lifter 154 to lift the laundry load received in the treating chamber 18 while the drum 16 rotates. The drum manifold portion 158 defines at least one drum manifold outlet 168. In an exemplary embodiment, the number of lifters 154 can be equal to the number of drum manifold outlets 168, though it will be understood that any suitable number of lifters 154 and drum manifold outlets 168 can be provided. Each drum manifold outlet 168 can be fluidly coupled to one of the lifters 154 via a lifter conduit 170 that extends between the drum manifold portion 158 and the lifter 154 to fluidly couple the common reservoir to the fluid reservoir of the lifter 154. It will also be understood that rather than including a dedicated lifter conduit 170 for each lifter 154, flow paths can be defined by the drum manifold portion 158 that can direct liquid to each of the fluidly coupled lifters 154, without the need for a separate conduit. Each of the lifters 154 can define a plurality of lifter outlets 172 through which liquid can flow from the lifters 154 into the treating chamber 18.

Figure 4:
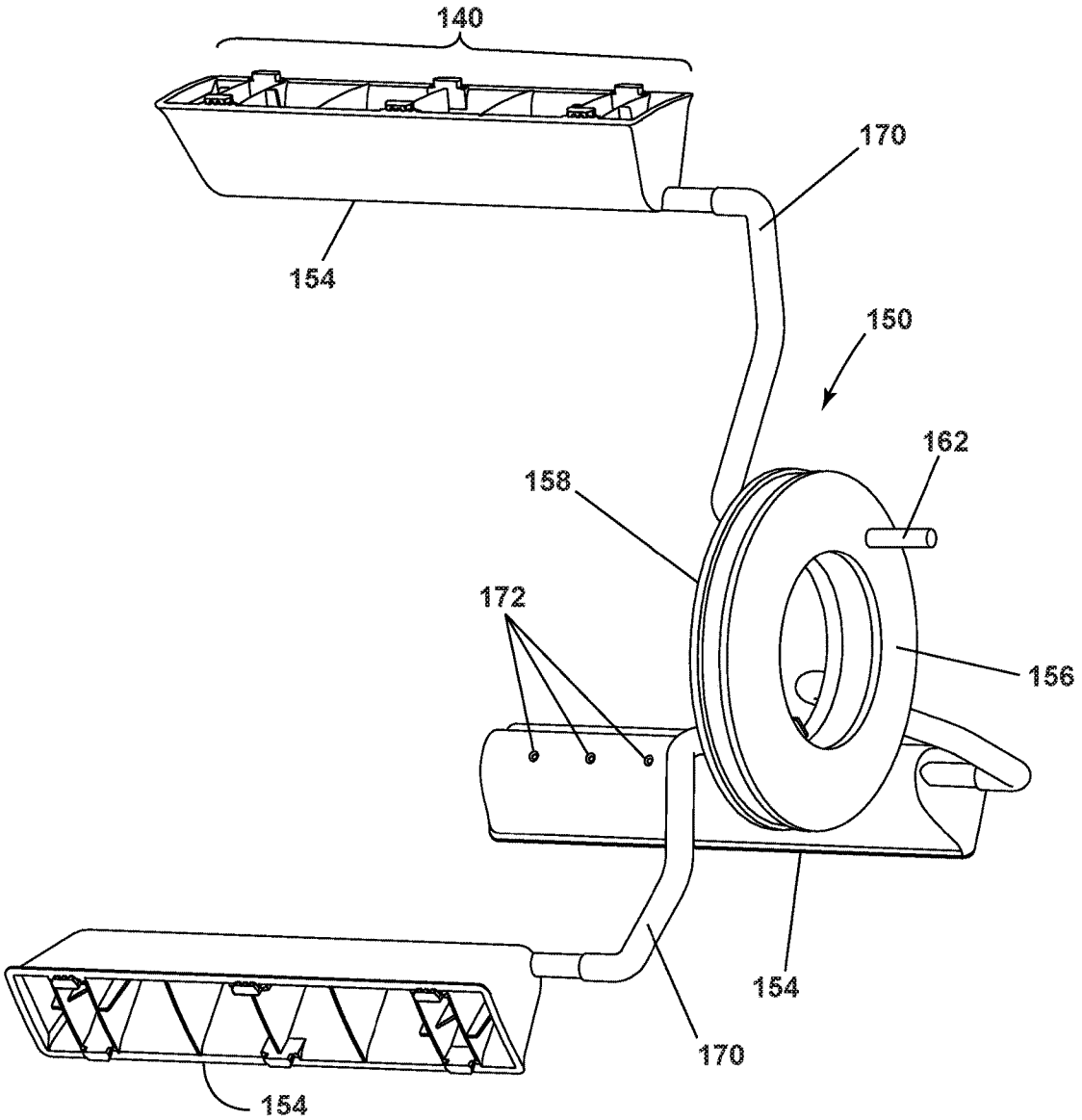
FIG. 4 illustrates a perspective view of a lifter assembly for use with the liquid distribution assembly of FIG. 3.

FIG. 4 illustrates a perspective view of just the lifter assembly 140 and the liquid distribution assembly 150 to more clearly show the structure of the lifter assembly 140 without the surrounding parts of the laundry treating appliance. The lifter conduits 170 fluidly couple the drum manifold portion 158 with the lifters 154. The tub manifold portion 156 can be aligned with and positioned adjacent the drum manifold portion 158 for selective fluid coupling with the drum manifold portion 158. The tub manifold inlet 162 is provided for attachment with the distribution conduit 152. While the lifter assembly 140 is illustrated herein as having three lifters 154, it will be understood that any suitable number of lifters 154 can be provided, including only a single lifter 154. While the lifters 154 are illustrated herein as having a generally triangular cross-sectional shape, it will be understood that the cross-sectional shape is not limiting and any suitable cross-sectional shape can be provided, non-limiting examples of which include fin shaped, square, rounded or oval, or trapezoidal.

Figure 5:
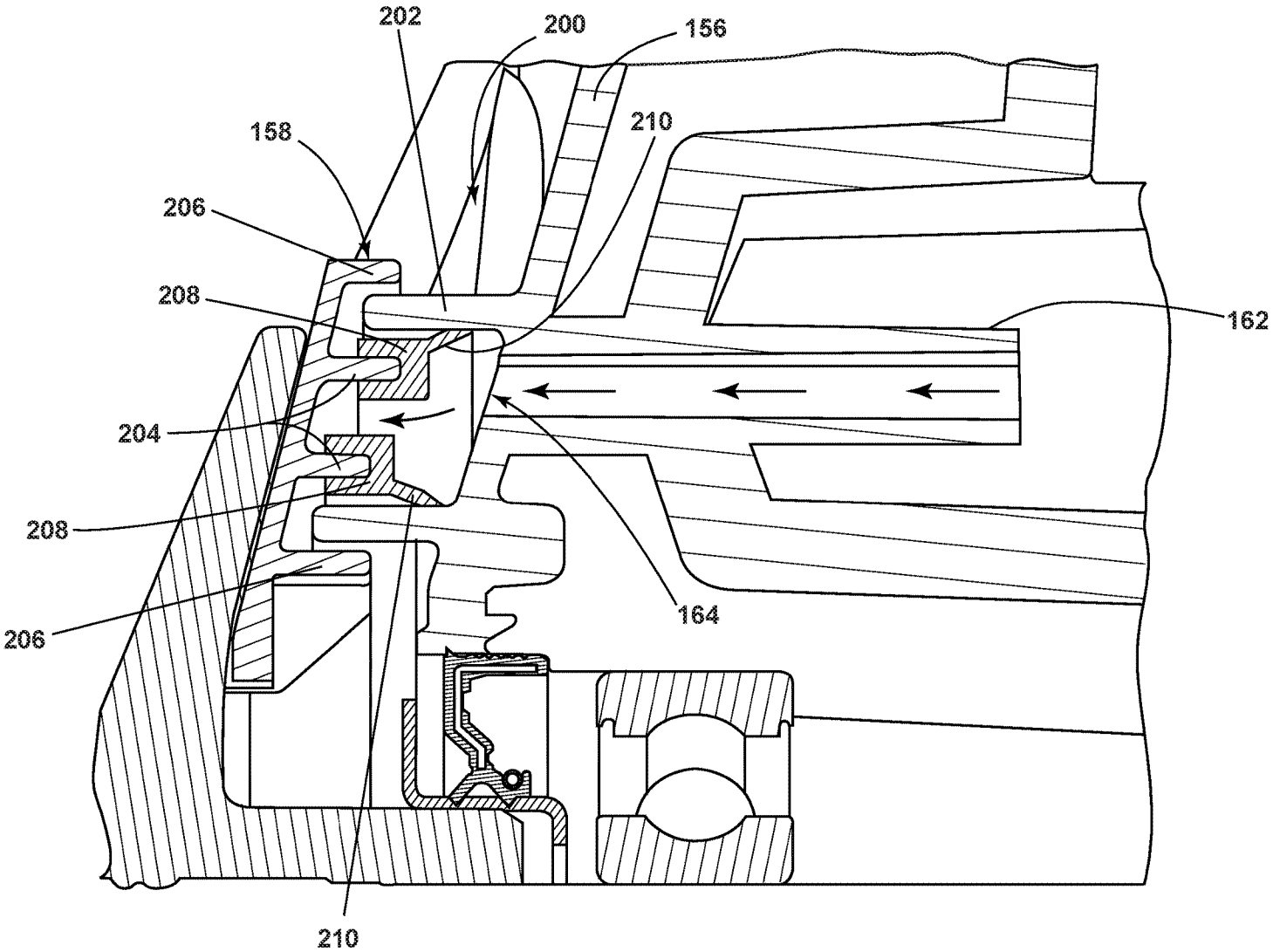
FIG. 5 illustrates an enlarged cross-sectional view of an interface between the tub and a drum for use with the liquid distribution assembly of FIG. 3 according to an embodiment of the present disclosure.

Referring now to FIG. 5, a sealing interface 200 seals the tub manifold portion 156 relative to the drum manifold portion 158 according to an embodiment of the present disclosure, since the tub 14, defining the tub manifold portion 156, is fixed and non-rotating within the washing machine 10, while the drum 16, including the drum manifold portion 158 can rotate with the drum 16. By preventing or minimizing the leakage of liquid between the tub manifold portion 156 and the drum manifold portion 158, the sealing interface 200 can ensure that the majority of the liquid passing through the liquid distribution assembly 150 is provided to the lifters 154.

The sealing interface 200 is defined by the tub manifold portion 156 and the drum manifold portion 158. Liquid that has entered the tub manifold portion 156 via the tub manifold inlet 162 can flow through the tub manifold portion 156 to the tub manifold outlet 164. The tub manifold outlet 164 can define a sealing surface 202. The sealing surface 202 can be provided adjacent the drum manifold portion 158. Specifically, the drum manifold portion 158 can define sealing ribs 204 and labyrinth ribs 206. The sealing ribs 204 can be positioned such that they are received within the sealing surface 202 of the tub manifold portion 156, while the labyrinth ribs 206 can in turn surround the sealing surface 202, such that the sealing ribs 204, sealing surface 202, and labyrinth ribs 206 together can be thought of as forming a labyrinth seal, which is defined by the tub manifold outlet 164 and the drum manifold inlet 166 to prevent the leaking of liquid between the tub manifold portion 156 and the drum manifold portion 158.

Further, the sealing ribs 204 can be provided with at least one sealing element 208, which, by way of non-limiting example, can be provided as a lip seal. The sealing element 208 can be mechanically coupled with the sealing ribs 204. In an exemplary embodiment, the sealing element 208 can define a sealing flange 210 that can resiliently bear against the sealing surface 202. In addition, the flow of liquid through the sealing interface 200 can apply pressure to the sealing element 208 and sealing flange 210 to cause the sealing flange 210 to bear against the sealing surface 202. Further, it is contemplated that the sealing flange 210 can be configured to only contact the sealing surface 202 when water pressure is present from liquid flowing through the sealing interface 200 in order to minimize wear to the sealing element 208. The sealing element 208 can be formed of any suitable material that can withstand the rotating movement of the drum manifold portion 158, and thus of the sealing element 208 against the sealing surface 202 of the tub manifold portion 156.

While the sealing interface 200 as illustrated herein has been described as comprising a lip seal and a labyrinth seal, it will be understood that the type of seal is not limiting, and that other types of suitable dynamic seals can be used such that a majority of the liquid enters the treating chamber 18. By way of non-limiting example, a sealing ring can be provided at the sealing interface 200, or a seal that is responsive to the spin speed of the drum 16 could be included, such that the seal is tight between the drum 16 and the tub 14 at low speeds of rotation, but is drawn away from the sealing interface 200 into a looser sealing position at higher rotational speeds.

Figure 6:
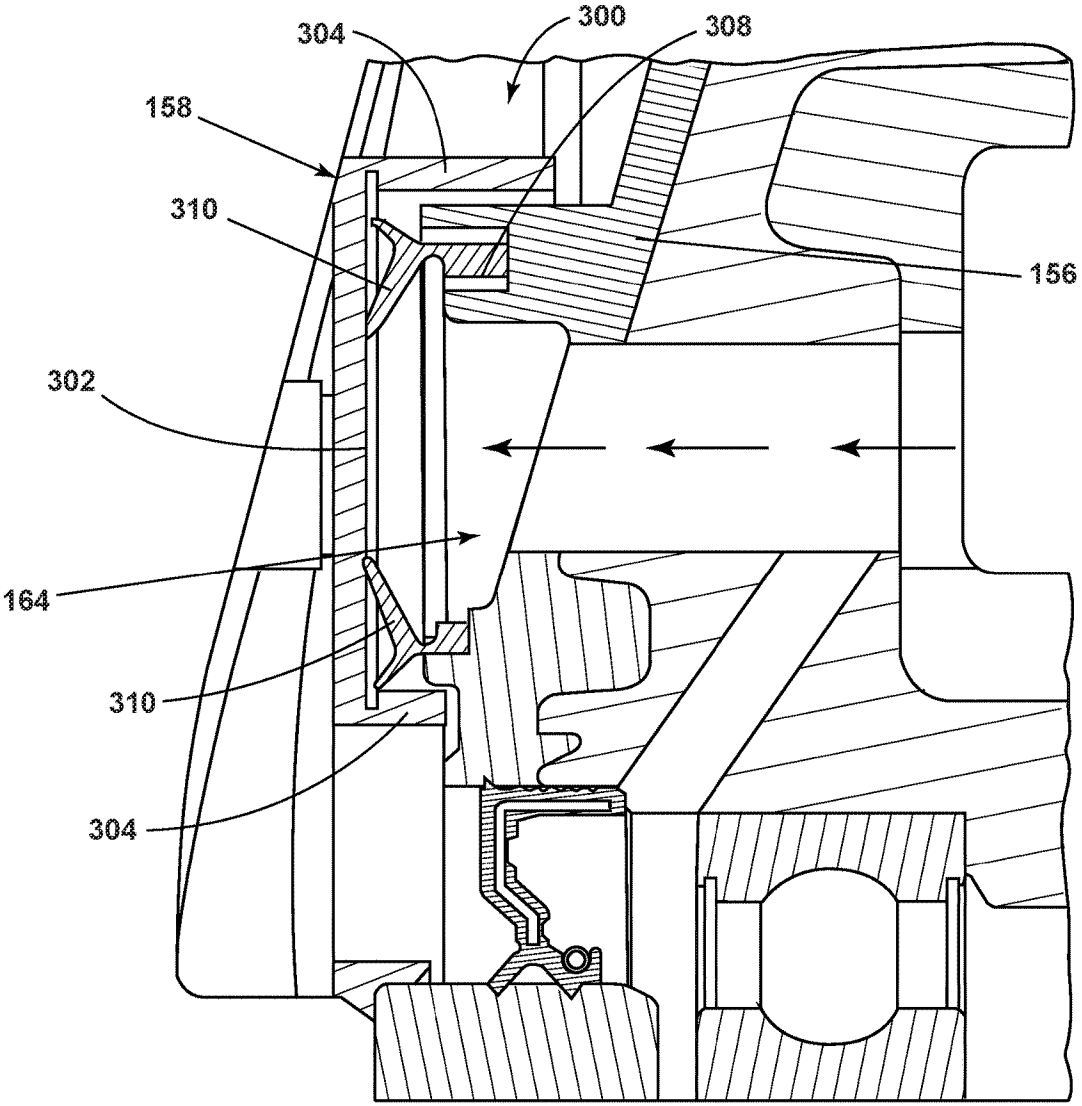
FIG. 6 illustrates an enlarged cross-sectional view of an interface between the tub and a drum for use with the liquid distribution assembly of FIG. 3 according to another embodiment of the present disclosure.

FIG. 6 illustrates an enlarged, cross-sectional view of the liquid distribution assembly 150 showing in detail a sealing interface 300 according to another embodiment of the present disclosure. The sealing interface 300 is defined by the tub manifold portion 156 and the drum manifold portion 158. The drum manifold portion 158 can define a sealing surface 302. The sealing surface 302 can be provided adjacent the tub manifold portion 156. In an exemplary embodiment, the sealing surface 302 can comprise a stainless steel plate that is overmolded by the plastic housing of the drum manifold portion 158. Sealing ribs 304 can be defined by the drum manifold portion 158 and can extend from the sealing surface 302. The tub manifold outlet 164 can be received within the sealing ribs 304. The sealing ribs 304 and the tub manifold outlet 164 together can be thought of as forming a labyrinth seal to prevent the leaking of liquid between the tub manifold portion 156 and the drum manifold portion 158.

Further, at least one sealing element 308 can be coupled to the tub manifold outlet 164. In an exemplary embodiment, the sealing element 308 can define a sealing flange 310 that can resiliently bear against the sealing surface 302. By way of non-limiting example, the sealing flange 310 can form a v-shaped ring, though it will be understood that any suitable shape or profile that will sufficiently seal against the sealing surface 302 can be implemented. In addition, the flow of liquid through the sealing interface 300 can apply pressure to the sealing element 308 and sealing flange 310 to cause the sealing flange 310 to bear against the sealing surface 302. Further, it is contemplated that the sealing flange 310 can be configured to only contact the sealing surface 302 when water pressure is present from liquid flowing through the sealing interface 300, in order to minimize wear to the sealing element 308. The sealing element 308 can be formed of any suitable material that can withstand the rotating movement of the drum manifold portion 158, and thus of the sealing element 308 against the sealing surface 302 of the drum manifold portion 158.

Turning now to the operation of the liquid distribution assembly 150, the pump 74 pumps liquid through the distribution conduit 152 to the tub manifold inlet 162. Liquid flows from the tub manifold inlet 162 to the tub manifold outlet 164. The tub manifold outlet 164 and the drum manifold inlet 166 are positioned such that they can be selectively aligned with one another to fluidly couple the tub 14 and the drum 16 as the drum 16 rotates during the operation of the washing machine 10. When the tub manifold outlet 164 and the drum manifold inlet 166 are aligned, liquid can flow through the sealing interface 200, 300 and enter the drum manifold portion 158 via the drum manifold inlet 166.

Liquid entering the drum manifold inlet 166 can exit via at least one of the drum manifold outlets 168, then enter at least one of the lifter conduits 170 to flow to at least one lifter 154 and enter the treating chamber 18 via the lifter outlets 172. The drum manifold portion 158 can include internal structures that the liquid confronts and that guide the liquid to at least one lifter conduit 170. The distribution of liquid between the lifter conduits 170 can be determined and controlled by water pressure generated by the pump 74. By way of non-limiting example, it is contemplated that all of the lifters 154 can be pressurized at the same time, or that internal walls within the drum manifold portion 158 are provided such that liquid is only provided to one or two lifters 154, or to less than all of the lifters 154, at one time. In an exemplary embodiment, liquid can be provided only to lifters 154 that are in the upper area of rotation of the drum 16 such that liquid can spray out of the lifter outlets 172 and spray across the drum 16 or down the drum 16 as the lifter 154 goes across the top portion of the drum 16. Once the liquid has entered the treating chamber 18 via the lifter outlets 172, the liquid flows by gravity to the sump 70, then to the pump 74 via the sump conduit 72, where it can then be provided again to the liquid distribution assembly 150.

The embodiments disclosed herein provide a liquid distribution assembly that can improve distribution of liquid within a washing machine treating chamber. By distributing the liquid through the lifters, improved washing performance can be achieved by ensuring that liquid reaches laundry items distributed throughout the treating chamber. In addition, the sealing interface provided between the tub and the drum allows for the passage of liquid to the lifters while minimizing water leak between the tub and the drum to ensure the majority of the liquid is delivered to the lifters. This can result in improvement in washing efficiency, reduction of cycle time, and reduction of energy consumption by the washing machine. Furthermore, the embodiments described herein provide a solution that allows for liquid flow through the rear of the tub and the drum without loss of tub stiffness. Allowing for improved washing performance while maintaining sufficient rear tub stiffness is accomplished with the structure disclosed herein.

To the extent not already described, the different features and structures of the various embodiments can be used in combination with each other as desired, or can be used separately. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described.

While the present disclosure has been specifically described in connection with certain specific embodiments thereof, it is to be understood that this is by way of illustration and not of limitation. Reasonable variation and modification are possible within the scope of the forgoing disclosure and drawings without departing from the spirit of the present disclosure. Hence, specific dimensions and other physical characteristics relating to the embodiments disclosed herein are not to be considered as limiting, unless expressly stated otherwise.

What is claimed is:

1. A laundry treating appliance, comprising:

a tub having a tub side wall and a tub end wall defining a liquid chamber with a tub end opening opposite the tub end wall;

a tub manifold portion positioned at the tub end wall;

a rotatable drum located within the liquid chamber, rotatable about a rotational axis, and having a drum side wall and a drum end wall at least partially defining a treating chamber with a drum end opening opposite the drum end wall;

a drum manifold portion positioned at the drum end wall and confronting the tub manifold portion;

at least one lifter secured to the drum;

a liquid conduit fluidly coupling the drum manifold portion to the at least one lifter; and a sealing interface formed between the tub manifold portion and the drum manifold portion and at least partially defined by at least one of the tub manifold portion and the drum manifold portion, the sealing interface comprising:

one of the tub manifold portion and the drum manifold portion comprising a sealing element, and the other of the tub manifold portion and the drum manifold portion comprising a sealing surface, the sealing element configured to selectively bear against the sealing surface when a flow of liquid through the sealing interface biases the sealing element against the sealing surface and to not contact the sealing surface when the flow of liquid is not flowing through the sealing interface.

2. The laundry treating appliance of claim 1 wherein the tub manifold portion and the drum manifold portion have interiors that are configured to be fluidly sealed with one another by the sealing interface to collectively define a common fluid reservoir.

3. The laundry treating appliance of claim 2 wherein the at least one lifter has an interior defining a fluid reservoir that is fluidly coupled to the common fluid reservoir.

4. The laundry treating appliance of claim 3 wherein the liquid conduit extends between the drum manifold portion and the at least one lifter to fluidly couple the common fluid reservoir to the fluid reservoir of the at least one lifter.

5. The laundry treating appliance of claim 1 wherein the tub manifold portion is mounted to the tub end wall or integrally formed with the tub end wall.

6. The laundry treating appliance of claim 1 wherein the drum manifold portion is mounted to the drum end wall or integrally formed with the drum end wall.

7. The laundry treating appliance of claim 1 wherein the at least one lifter comprises a plurality of outlets through which liquid is supplied from the at least one lifter to the treating chamber.

8. The laundry treating appliance of claim 1 wherein the tub manifold portion defines a tub manifold inlet and a tub manifold outlet.

9. The laundry treating appliance of claim 8 wherein the drum manifold portion defines a drum manifold inlet and at least one drum manifold outlet.

10. The laundry treating appliance of claim 9 wherein the sealing interface is formed between the tub manifold outlet and the drum manifold inlet and at least partially defined by at least one of the tub manifold outlet and the drum manifold inlet.

11. The laundry treating appliance of claim 10 wherein the sealing interface comprises a labyrinth seal.

12. The laundry treating appliance of claim 11 wherein the labyrinth seal is defined by the tub manifold outlet and the drum manifold inlet.

13. The laundry treating appliance of claim 10 wherein the sealing interface comprises a lip seal.

14. The laundry treating appliance of claim 10 wherein one of the tub manifold outlet and the drum manifold inlet comprises the sealing element.

15. The laundry treating appliance of claim 14 wherein the other of the tub manifold outlet and the drum manifold inlet comprises the sealing surface.

16. The laundry treating appliance of claim 15 wherein the sealing element bears against the sealing surface to prevent liquid from leaking between the tub manifold outlet and the drum manifold inlet.

17. The laundry treating appliance of claim 10 wherein the tub manifold inlet is fluidly coupled to a pump for providing liquid to the tub manifold inlet.

18. The laundry treating appliance of claim 1 wherein supplying liquid to the at least one lifter is controlled by water pressure.

19. The laundry treating appliance of claim 18 wherein the at least one lifter comprises more than one lifter and liquid can be selectively supplied to less than all of the lifters at one time.

20. A laundry treating appliance, comprising:

a tub having a tub side wall and a tub end wall defining a liquid chamber with a tub end opening opposite the tub end wall;

a tub manifold portion positioned at the tub end wall;

a rotatable drum located within the liquid chamber, rotatable about a rotational axis, and having a drum side wall and a drum end wall at least partially defining a treating chamber with a drum end opening opposite the drum end wall;

a drum manifold portion positioned at the drum end wall and confronting the tub manifold portion;

at least one lifter secured to the drum;

a liquid conduit fluidly coupling the drum manifold portion to the at least one lifter; and a sealing interface comprising a labyrinth seal formed between the tub manifold portion and the drum manifold portion and at least partially defined by at least one of the tub manifold portion and the drum manifold portion, the sealing interface comprising:

one of the tub manifold portion and the drum manifold portion comprising a sealing element having at least one sealing rib and at least one labyrinth rib, and the other of the tub manifold portion and the drum manifold portion comprising a sealing surface, wherein the at least one sealing rib is received interiorly of the sealing surface and the at least one labyrinth rib surrounds the sealing surface, such that the at least one sealing rib, the sealing surface, and the at least one labyrinth rib collectively form the labyrinth seal.

* * * * *